US011065633B2

(12) United States Patent
Ueda et al.

(10) Patent No.: US 11,065,633 B2
(45) Date of Patent: Jul. 20, 2021

(54) SPRAYING APPARATUS

(71) Applicant: Panasonic Intellectual Property Management Co., Ltd., Osaka (JP)

(72) Inventors: Yuki Ueda, Osaka (JP); Akira Isomi, Osaka (JP); Daisuke Tabata, Osaka (JP)

(73) Assignee: PANASONIC INTELLECTUAL PROPERTY MANAGEMENT CO., LTD., Osaka (JP)

( * ) Notice: Subject to any disclaimer, the term of this patent is extended or adjusted under 35 U.S.C. 154(b) by 167 days.

(21) Appl. No.: 16/270,527

(22) Filed: Feb. 7, 2019

(65) Prior Publication Data

US 2019/0255544 A1 Aug. 22, 2019

(30) Foreign Application Priority Data

Feb. 21, 2018 (JP) ..... 2018-028529

(51) Int. Cl.
*B05B 7/04* (2006.01)
*B05B 1/34* (2006.01)
(Continued)

(52) U.S. Cl.
CPC ..... *B05B 7/1606* (2013.01); *B05B 1/002* (2018.08); *B05B 7/0458* (2013.01); *B05B 1/3402* (2018.08)

(58) Field of Classification Search
CPC ..... B05B 1/002; B05B 1/3402; B05B 7/0458; B05B 7/0475; B05B 7/0483; B05B 7/10; B05B 7/1606; B05B 7/0441; B05B 7/0491
See application file for complete search history.

(56) References Cited

U.S. PATENT DOCUMENTS 3,642,202 A * 2/1972 Angelo ..... B05B 7/10 239/8
3,790,086 A 2/1974 Masai
(Continued)

FOREIGN PATENT DOCUMENTS

CN 104540597 4/2015
JP 52-7165 1/1977
(Continued)

OTHER PUBLICATIONS

Extended European Search Report dated Jul. 23, 2019 in European Patent Application No. 19152046.9.
(Continued)

*Primary Examiner* — Alex M Valvis
(74) *Attorney, Agent, or Firm* — Wenderoth, Lind & Ponack, L.L.P.

(57) ABSTRACT

A spraying apparatus includes a spraying apparatus main body, a liquid introduction portion, a gas-liquid spout portion, a gas introduction portion, a liquid inlet, a first gas inlet passage, a second gas inlet passage, and a spout. The first gas inlet passage is provided at at least one place of the annular gas introduction portion so as to communicate with the gas flow passage and the gas-liquid mixer, and allows a gas flow flowing through the gas flow passage to enter the gas-liquid mixer. The second gas inlet passage has a gas inlet having a predetermined area ratio, is provided on a downstream side of the first gas inlet passage of the gas introduction portion, and communicates with the gas flow passage and the gas-liquid mixer.

6 Claims, 9 Drawing Sheets

(51) Int. Cl.
*B05B 7/16* (2006.01)
*B05B 1/00* (2006.01)

(56) References Cited

U.S. PATENT DOCUMENTS 3,979,069 A * 9/1976 Garofalo ..... F23D 11/12 239/400
6,267,301 B1 * 7/2001 Haruch ..... B05B 7/0458 239/290
6,997,405 B2 * 2/2006 Haruch ..... B05B 7/10 239/690
2003/0052197 A1 * 3/2003 Bui ..... B05B 7/0475 239/416.4
2010/0276507 A1 * 11/2010 Labegorre ..... B05B 7/0815 239/11
2013/0181063 A1 7/2013 Asakawa et al.
2014/0048622 A1 2/2014 Haruch
2017/0203313 A1 7/2017 Tabata et al.
2017/0266674 A1 9/2017 Isomi et al.
2017/0304851 A1 * 10/2017 Paal ..... B05B 7/0483

FOREIGN PATENT DOCUMENTS

JP 2015-524745 8/2015
JP 2017-127814 7/2017
JP 2017-170422 9/2017
WO 00/58014 10/2000
WO 20121039343 3/2012

OTHER PUBLICATIONS

English Translation of Chinese Search Report dated Aug. 24, 2020 in corresponding Chinese Patent Application No. 201910119311.2.

* cited by examiner

FIG. 5

| OPENING HEIGHT [mm] | AREA RATIO OF SECOND GAS INLET [-] | PARTICLE DIAMETER [μm] | NOISE VALUE [dB] |
|---|---|---|---|
| 0 (RELATED ART) | 0 (RELATED ART) | 8.5 | 76 |
| 0.05 | 0.25 | 8.8 | 74 |
| 0.1 | 0.5 | 8.5 | 73 |
| 0.2 | 1.0 | 8.7 | 72 |
| 0.3 | 1.5 | 8.8 | 72 |
| 0.4 | 2.0 | 9.1 | 71 |
| 0.5 | 2.5 | 9.4 | 70 |
| 0.6 | 3.0 | 10.2 | 69 |

FIG. 6

| OPENING HEIGHT [mm] | AREA RATIO OF SECOND GAS INLET [-] | PARTICLE DIAMETER [μm] | NOISE VALUE [dB] |
|---|---|---|---|
| 0 (RELATED ART) | 0 | 8.5 | 76 |
| 2.25 | 0.125 | 8.5 | 76 |
| 4.50 | 0.250 | 8.8 | 75 |
| 6.75 | 0.375 | 8.9 | 75 |
| 9.0 | 0.500 | 8.8 | 75 |
| 11.3 | 0.625 | 9.1 | 73 |
| 13.5 | 0.750 | 8.1 | 73 |
| 15.8 | 0.875 | 9.8 | 72 |
| 18.0 | 1.000 | 8.6 | 72 |

SPRAYING APPARATUS

BACKGROUND

1. Technical Field

The present disclosure relates to a spraying apparatus of a two-fluid nozzle type which atomizes a liquid using a gas.

2. Description of the Related Art

A nozzle for atomizing a liquid is widely used in a space/material cooling apparatus, a humidifying apparatus, a chemical solution dispensing apparatus, a combustion apparatus, a dust control apparatus, or the like. The atomizing nozzle can be broadly divided into a single-fluid nozzle for atomizing a liquid by spouting the liquid from a micro aperture and a two-fluid nozzle for atomizing a liquid by using a gas such as an air, nitrogen, or steam. In general, the two-fluid nozzle is superior to the single-fluid nozzle in atomization performance because the two-fluid nozzle atomizes a liquid using energy of a gas.

As an example of the two-fluid nozzle for atomizing the liquid, for example, there is a two-fluid nozzle described in Japanese Patent Unexamined Publication No. 2017-170422. As illustrated in FIG. 8, the two-fluid nozzle described in Japanese Patent Unexamined Publication No. 2017-170422 includes spraying apparatus main body 310*a*, inner lid 313, and outer lid 314. Gas-liquid mixer 315 is formed of inner lid 313, annular portion 324, and outer lid 314. Spraying apparatus 310 further includes spraying apparatus lid fixer 317.

In spraying apparatus 310, a liquid flow is introduced from an inner end surface 313*a* side of inner lid 313. A gas flow is introduced from a surface opposite thereto to collide with the liquid flow. A gas-liquid mixed fluid flow advances to spout portion 316 while circulating around an inner surface of annular portion 324, and thereby atomization of the liquid in gas-liquid mixer 315 is promoted. Therefore, it is possible to provide a spraying apparatus capable of spraying a liquid having a small particle diameter, which is quickly vaporized and has little wetting or the like.

SUMMARY

A spraying apparatus includes a spraying apparatus main body, a liquid introduction portion, a gas-liquid spout portion, a gas introduction portion, a liquid inlet, a first gas inlet passage, a second gas inlet passage, and a spout.

The spraying apparatus main body has a liquid flow passage and a gas flow passage.

The liquid introduction portion is on a central axis of the spraying apparatus main body, is disposed at a tip of a cylindrical portion forming the liquid flow passage on an inside thereof, and covers an opening of the cylindrical portion.

The gas-liquid spout portion is disposed at a tip of the spraying apparatus main body, covers the liquid introduction portion, and covers an opening of the gas flow passage.

The gas introduction portion has an annular shape, is positioned between the liquid introduction portion and the gas-liquid spout portion, and is in contact with the liquid introduction portion and the gas-liquid spout portion.

The liquid inlet is provided at at least one place in a position distant from the central axis of an end surface of the liquid introduction portion on a downstream side, communicates with a gas-liquid mixer surrounded by the liquid introduction portion, the gas introduction portion, and the gas-liquid spout portion, and allows a liquid flow flowing through the liquid flow passage to enter the gas-liquid mixer.

The first gas inlet passage is provided at at least one place of the annular gas introduction portion so as to communicate with the gas flow passage and the gas-liquid mixer, and allows a gas flow flowing through the gas flow passage to enter the gas-liquid mixer.

The second gas inlet passage has a gas inlet having a predetermined area ratio, is provided on a downstream side of the first gas inlet passage of the gas introduction portion, and communicates with the gas flow passage and the gas-liquid mixer.

The spout is provided in the gas-liquid spout portion, communicates with the gas-liquid mixer, and spouts an atomized liquid in the gas-liquid mixer.

BRIEF DESCRIPTION OF THE DRAWINGS

FIG. 3A is an enlarged perspective view of a gas introduction portion in

FIG. 2;

FIG. 5 is a diagram illustrating a correlation table between an area ratio of a second gas inlet passage, a particle diameter, and a noise value in a case where an opening height is changed;

FIG. 6 is a diagram illustrating a correlation table between an area ratio of the second gas inlet passage, a particle diameter, and a noise value in a case where a sum of an opening length is changed;

DETAILED DESCRIPTIONS

In the configuration of the two-fluid nozzle of the related art described in Japanese Patent Unexamined Publication No. 2017-170422, noise of 75 dB or more (when measuring the noise with A characteristic) may occur due to collision between air and water required for producing a liquid atomized to a particle diameter of 10 μm or less, or a flow generated at the time of spraying. If the particle diameter of the liquid is 10 μm or less and if the noise at the time of spraying can be reduced, the spraying apparatus can be used in a quiet environment such as indoors or as a countermeasure against heat. In a case where the two-fluid nozzle of the related art is used in the application described above, a countermeasure to reduce noise, such as shielding noise or keeping a nozzle spray position away from a user is required. Therefore, in the related art, a location or use of the nozzle is limited.

Hereinafter, exemplary embodiments of the disclosure will be described with reference to the drawings.

The exemplary embodiments relate to spraying apparatus 10 that atomizes and sprays a liquid by using a gas. An example of the gas includes air, nitrogen, oxygen, inert gas, or the like, which can be appropriately selected according to a purpose of use. An example of the liquid includes, water, ozone water, a chemical solution having a sterilizing and sterilizing function, a paint, a fuel oil, or the like, which can be appropriately selected according to the purpose of use.

In describing the embodiment of the disclosure, a configuration of spraying apparatus 10 will be described first.

Figure 1:
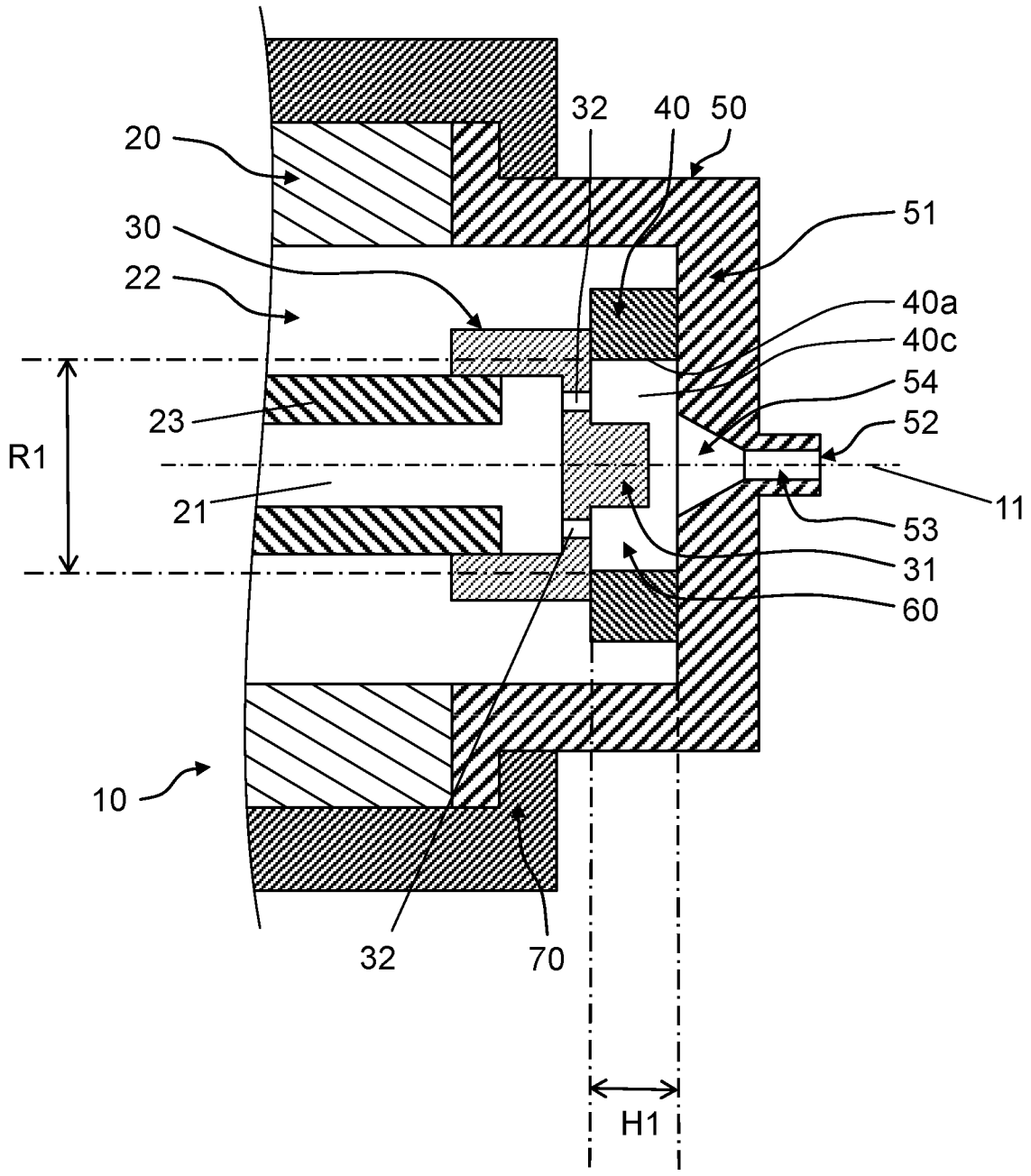
FIG. 1 is a sectional view of a spraying apparatus in an embodiment.

FIG. 1 is a sectional view of spraying apparatus 10 in the embodiment of the disclosure. Spraying apparatus 10 includes at least spraying apparatus main body 20, liquid introduction portion 30, gas introduction portion 40, and gas-liquid spout portion 50. Liquid introduction portion 30, gas introduction portion 40, and gas-liquid spout portion 50 constitute gas-liquid mixer 60. Spraying apparatus 10 may further include gas-liquid spout fixer 70.

Liquid flow passage 21 which is disposed along a direction of central axis 11 at a center portion of a columnar member is formed in spraying apparatus main body 20. Furthermore, cylindrical gas flow passages 22 which are disposed along the direction of central axis 11 are formed with a gap around liquid flow passage 21. Liquid flow passage 21 and gas flow passages 22 are sectioned by cylindrical portion 23 positioned at the center portion as a part of spraying apparatus main body 20. Only a tip side of liquid flow passage 21 is illustrated and a liquid supply port (not illustrated) of a rear end is connected to, for example, a pump or the like connected to a liquid tank via a water supply pipe. Also, only a tip side of gas flow passage 22 is illustrated and a gas supply port (not illustrated) of a rear end is connected to, for example, an air source or the like configured of an air compressor via a gas supply pipe.

Liquid introduction portion 30 is disposed at a tip of spraying apparatus main body 20 and covers a tip opening of liquid flow passage 21. Liquid inlet 32 penetrating in the direction of central axis 11 is formed at at least one place distant from central axis 11 of liquid introduction portion 30 in a radial direction.

Liquid inlet 32 is formed of a hole (through-hole) penetrating an end surface of liquid introduction portion 30 along central axis 11. Liquid flow 61 flowing through liquid flow passage 21 passes through the through-hole (liquid inlet 32) and enters gas-liquid mixer 60. Liquid inlet 32 communicates with circular through-hole 40*c* of annular gas introduction portion 40, for example, on an upstream side of gas-liquid mixer 60. Liquid inlet 32 is a through-hole positioned in the vicinity of inner peripheral surface 40*a* of circular through-hole 40*c*. At least one through-hole is disposed in liquid introduction portion 30. For example, as illustrated in FIGS. 3B and 4B, two through-holes are disposed in liquid introduction portion 30 with an interval of 180 degrees. Liquid flow passage 21 and gas-liquid mixer 60 communicate with each other through the through-holes, and a liquid flowing through liquid flow passage 21 enters gas-liquid mixer 60. Columnar projection portion 31 protruding along central axis 11 toward gas-liquid mixer 60 is provided on an end surface of liquid introduction portion 30 on a downstream side. Projection portion 31 is disposed closer to the central axis than liquid inlet 32, but it is particularly necessary.

Gas-liquid spout portion 50 is a member having a cross section of substantially Ω shape and is disposed at the tip of spraying apparatus main body 20. Gas-liquid spout portion 50 covers liquid introduction portion 30 and gas introduction portion 40, and covers gas flow passage 22 to form a cylindrical gap. Therefore, gas introduction portion 40 is sandwiched and fixed between gas-liquid spout portion 50 and liquid introduction portion 30 along the central axis. Although gas introduction portion 40 and liquid introduction portion 30 are described as separate members, the disclosure is not limited thereto and gas introduction portion 40 and liquid introduction portion 30 may be integrally formed as one member.

Tubular flow passage 53 that causes the gas-liquid mixed fluid to exit and spout 52 that communicates with tubular flow passage 53 to spout the gas-liquid mixed fluid are formed at tip portion 51 of gas-liquid spout portion 50. Tapered truncated conical straightening passage 54 communicating with tubular flow passage 53 is formed on an inner surface of tip portion 51.

Gas-liquid spout fixer 70 holds and fixes gas-liquid spout portion 50 with the end surface of spraying apparatus main body 20. Gas-liquid spout portion 50 may be directly fixed to the end surface of spraying apparatus main body 20 without gas-liquid spout fixer 70.

Figure 2:
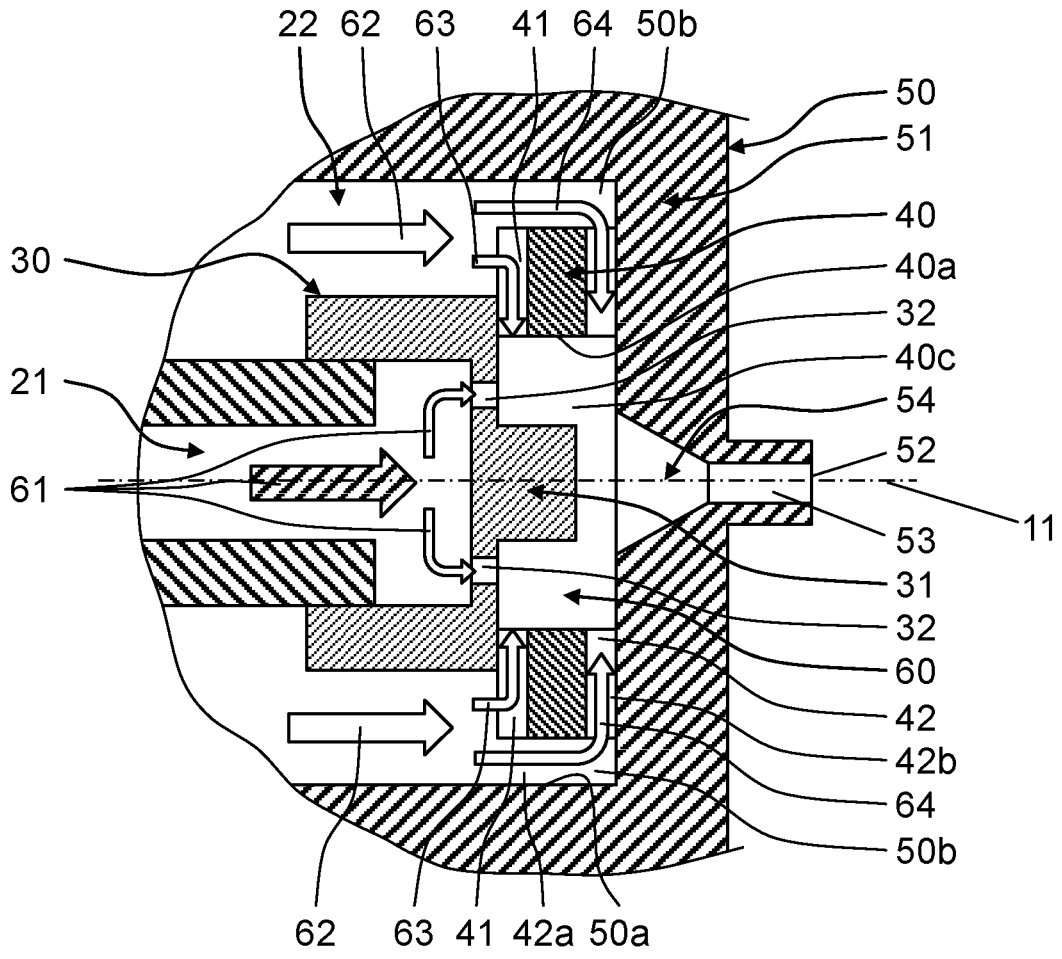
FIG. 2 is an enlarged sectional view of a gas-liquid mixer in the spraying apparatus illustrated in FIG. 1.

FIG. 2 is an enlarged sectional view of gas-liquid mixer 60 in spraying apparatus 10 in the embodiment. A diagonally shaded thick arrow illustrated in FIG. 2 includes a direction of the flow of the liquid in spraying apparatus 10. Thick white arrows indicate the direction of the gas in spraying apparatus 10.

Gas introduction portion 40 is formed by an annular member. First gas inlet passage 41 and second gas inlet passage 42 communicating with gas flow passage 22 and gas-liquid mixer 60 are formed in gas introduction portion 40. First gas inlet passage 41 and second gas inlet passage 42 are formed by cutting out a part of gas introduction portion 40. In gas introduction portion 40, circular through-hole 40*c* penetrates in the axial direction and circular through-hole 40*c* forms a part of gas-liquid mixer 60.

Figure 3A:
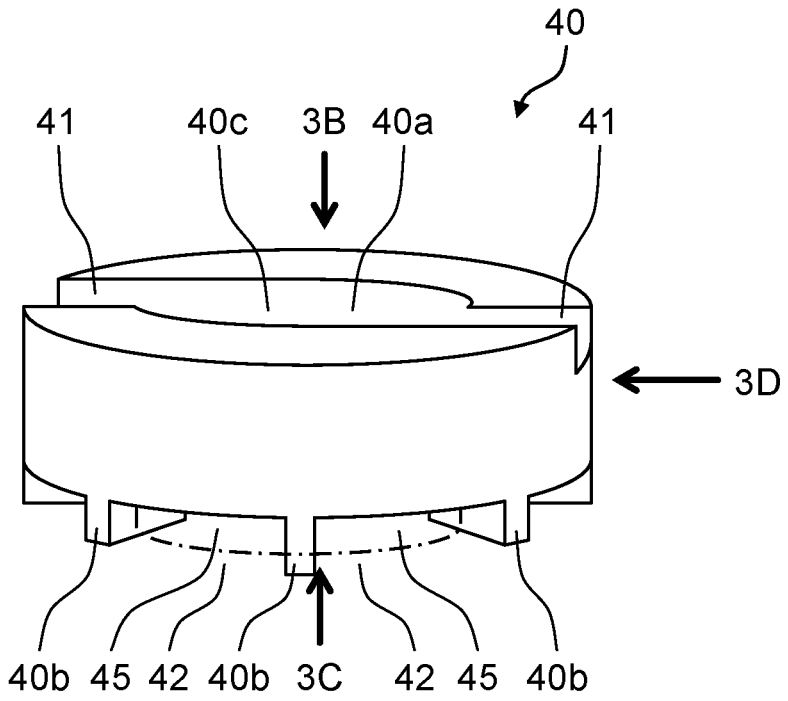
Figure 3B:
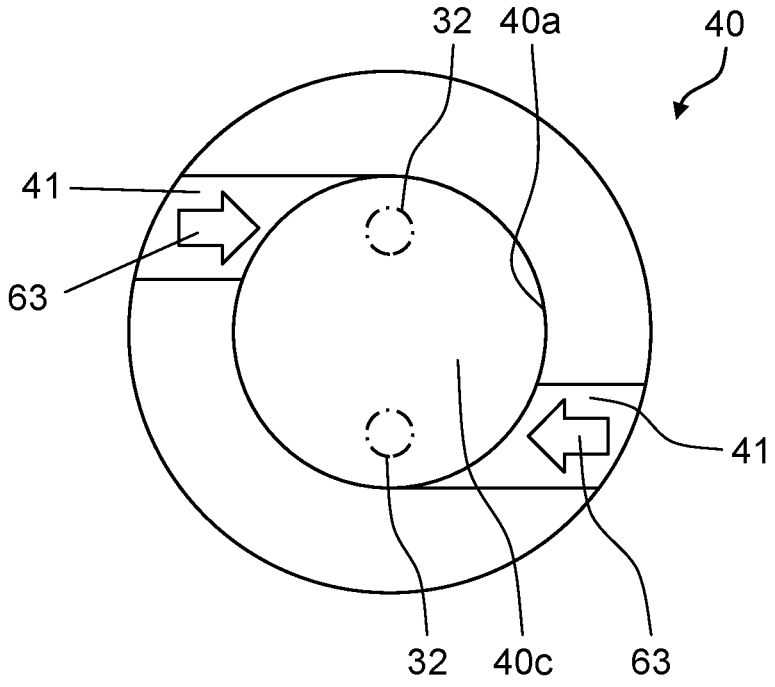
FIG. 3B is a view of the gas introduction portion as viewed from arrow 3B illustrated in FIG. 3A.
Figure 3C:
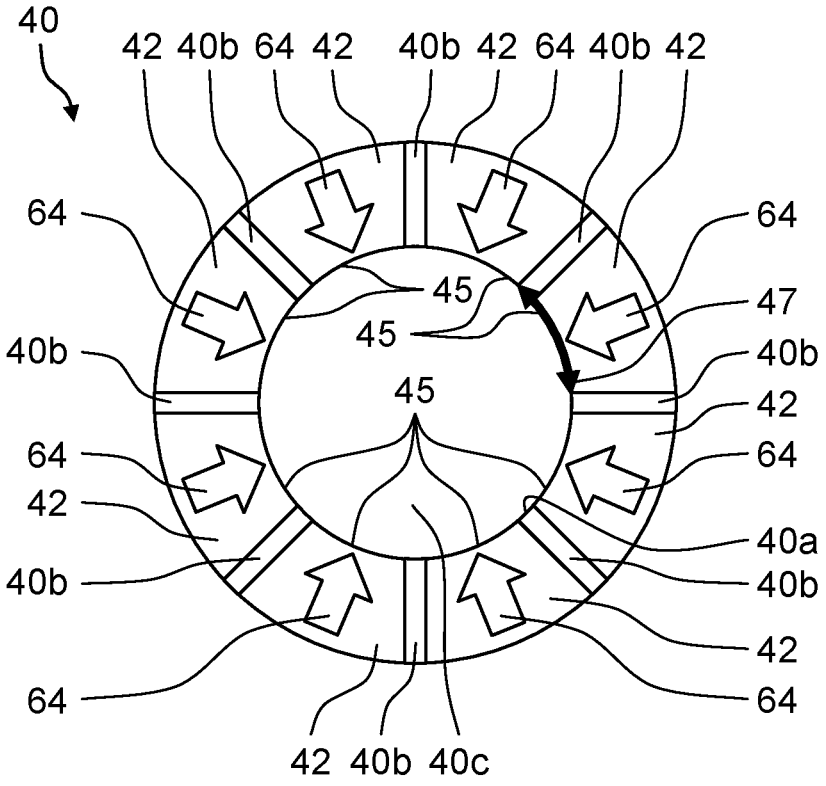
FIG. 3C is a view of the gas introduction portion as viewed from arrow 3C illustrated in FIG. 3A.
Figure 3D:
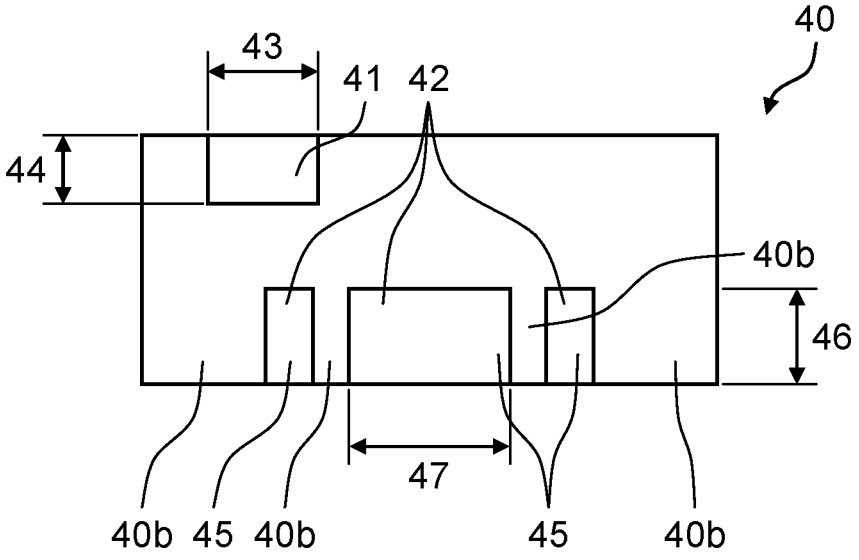
FIG. 3D is a view of the gas introduction portion as viewed from arrow 3D illustrated in FIG. 3A.

FIG. 3A illuminates an enlarged perspective view of gas introduction portion 40 in FIG. 2. FIG. 3B illustrates a view of gas introduction portion 40 which is taken in a direction of arrow 3B illustrated in FIG. 3A as viewed from an upstream side to a downstream side. FIG. 3C illustrates a view of gas introduction portion 40 which is taken in a direction of arrow 3C illustrated in FIG. 3A as viewed from the downstream side to the upstream side. FIG. 3D illustrates a view of gas introduction portion 40 which is taken in a direction of arrow 3D illustrated in FIG. 3A. Here, the upstream side is a side on which spraying apparatus main body 20 is formed and the downstream side is a side on which spout 52 is formed in FIG. 1.

First gas inlet passage 41 is formed of a first gap which is formed to extend along a direction (for example, an orthogonal direction) intersecting the direction of central axis 11 between liquid introduction portion 30 and an end portion of gas introduction portion 40 on an upstream side and communicates with gas flow passage 22 and gas-liquid mixer 60. Specifically, first gas inlet passage 41 is formed of a groove which is formed by cutting out at least one place (for example, two places in FIG. 3A) in a rectangular cross-sectional shape having groove width 43 and groove height 44 at a portion on a rear end side (in other words, the upstream side) of annular gas introduction portion 40 (see FIG. 3D). The groove communicates with circular through-hole 40*c* and is disposed along a tangential direction of inner peripheral surface 40*a* of annular gas introduction portion 40. A part of the end surface on the upstream side of a portion other than first gas inlet passage 41 of annular gas introduction portion 40 is in contact with the end surface on the downstream side of liquid introduction portion 30.

With the configuration described above, first gas flow 63 entering from first gas inlet passage 41 intersects liquid flow 61 entering from liquid inlet 32 in gas introduction portion 40, and flows along an inner periphery of gas introduction portion 40. In FIG. 3B, two first gas inlet passages 41 are formed with an interval of 180 degrees with respect to the center of gas introduction portion 40, and each first gas inlet passage 41 is disposed at a position intersecting with liquid inlet 32.

Second gas inlet passage 42 is formed of second gap 42*a* and third gap 42*b*.

Second gap 42*a* is formed to extend along the direction of central axis 11 between gas-liquid spout portion 50 and an outer surface (for example, an outer peripheral surface) of gas introduction portion 40, and communicates with gas flow passage 22. A diameter of gas introduction portion 40 is formed smaller than a diameter of recessed portion 50*a* having a cross section of substantially Ω shape of gas-liquid spout portion 50, and a part of second gas flow 64 from gas flow passage 22 to gas-liquid mixer 60 is formed in second gap 42*a* between the inner peripheral surface of recessed portion 50*a* and the outer peripheral surface of gas introduction portion 40.

Third gap 42*b* is formed to extend along a direction (for example, the orthogonal direction) intersecting the direction of central axis 11 between gas-liquid spout portion 50 and the end portion of gas introduction portion 40 on the downstream side, and communicates with second gap 42*a* and gas-liquid mixer 60.

Specifically, second gas inlet passage 42 is formed by cutting out a portion of gas introduction portion 40 on a tip side (in other words, the downstream side) along a radial direction with central axis 11 as a center having predetermined opening height 46 along central axis 11 and opening length 47 along the direction orthogonal to central axis 11 to communicate with circular through-hole 40*c* (see FIG. 3D). In other words, second gas inlet passage 42 is partitioned in a circumferential direction by partition wall 40*b* standing along the direction of the central axis so as to extend along the radial direction of gas introduction portion 40. An end surface of partition wall 40*b* on the downstream side is in contact with the inner surface of recessed portion 50*a* of gas-liquid spout portion 50. That is, in second gas inlet passage 42, on the downstream side of first gas inlet passage 41, second gas flow 64 passes through second gap 42*a* between the inner peripheral surface of recessed portion 50*a* and the outer peripheral surface of gas introduction portion 40 in a direction parallel to central axis 11. Thereafter, a flow direction of second gas flow 64 is changed to a center side in third gap 42*b*. Second gas flow 64 enters central axis 11, that is, an inside of circular through-hole 40*c* through gas inlet 45 in third gap 42*b* (see FIG. 3A). As described above, each portion is disposed so that second gas flow 64 flows. Here, gas inlet 45 indicates a surface on inner peripheral surface 40*a* of gas introduction portion 40 where second gas flow 64 enters gas-liquid mixer 60, and, in the embodiment, forms a curved surface along inner peripheral surface 40*a* of gas introduction portion 40.

As described above, gas-liquid mixer 60 communicates with liquid inlet 32, first gas inlet passage 41, second gas inlet passage 42, and tubular flow passage 53. Spout 52 communicates with gas-liquid mixer 60 via tubular flow passage 53.

Liquid inlet 32 penetrates liquid introduction portion 30 along the direction of central axis 11 on the upstream side of gas-liquid mixer 60.

First gas inlet passage 41 has a shape having a rectangular cross-sectional shape by cutting out gas introduction portion 40 along a direction intersecting central axis 11 on the upstream side of gas-liquid mixer 60.

Second gas inlet passage 42 is disposed on the downstream side of first gas inlet passage 41 on the downstream side of gas-liquid mixer 60, and has a shape obtained by cutting out inner peripheral surface 40*a* of gas introduction portion 40 with a predetermined opening height 46 along the direction intersecting central axis 11.

Tubular flow passage 53 penetrates gas-liquid spout portion 50 along the direction of central axis 11 on the downstream side of gas-liquid mixer 60.

In such a configuration, as illustrated in FIG. 2, the liquid supplied on spraying apparatus 10 becomes liquid flow 61 flowing through liquid flow passage 21 from a liquid supply port (not illustrated) to the tip side of the apparatus with respect to spraying apparatus main body 20. Liquid flow 61 is supplied on gas-liquid mixer 60 through liquid inlet 32 in liquid introduction portion 30. The gas supplied on spraying apparatus 10 becomes gas flow 62 flowing through gas flow passage 22 from a gas supply port (not illustrated) to the tip side of the apparatus with respect to spraying apparatus main body 20. Gas flow 62 branches into first gas flow 63 and second gas flow 64 in the vicinity of gas introduction portion 40 in gas flow passage 22, and branched flows are respectively supplied on gas-liquid mixer 60. First gas flow 63 is supplied on the upstream side of gas-liquid mixer 60 and second gas flow 64 is supplied on the downstream side of gas-liquid mixer 60.

When first gas flow 63 along the direction intersecting the direction of central axis 11 and liquid flow 61 along the direction of central axis 11 are supplied on gas-liquid mixer 60, the flows are mixed with each other in gas-liquid mixer 60 and the liquid is atomized. A turbulence inside gas-liquid mixer 60 generated by the collision of first gas flow 63 and liquid flow 61 is straightened by second gas flow 64 in the vicinity of tip portion 51. Here, second gas flow 64 is directed in the direction intersecting the direction of central axis 11 and to the center. Occurrence of noise is suppressed by reducing the turbulence generated when the liquid is spouted from spout 52 to the outside of spraying apparatus 10. Therefore, spraying apparatus 10 can efficiency atomize the liquid to a particle diameter of 10 μm or less by the gas, suppress the turbulence generated on the inside thereof, and reduce noise during spraying.

In spraying apparatus 10 of the embodiment, gas introduction portion 40 forming gas-liquid mixer 60 has a cylindrical shape having inner diameter R1 of 6.0 mm and height H1 of 1.9 mm (see FIG. 1). Spout 52 of gas-liquid spout portion 50 has a diameter of 1.0 mm, tubular flow passage 53 has a diameter of 1.0 mm and a length of 1.0 mm, and truncated conical straightening passage 54 has a diameter of 3.0 mm on a wide side, a diameter 1.0 mm on a narrow side, and a length of 2.0 mm. A diameter of liquid inlet 32 is 0.6 mm. First gas inlet passage 41 has a rectangular the cross-sectional shape having groove width 43 of 2.0 mm and groove height 44 of 1.0 mm (see FIG. 3D), and is formed at two places at positions symmetrical with respect to central axis 11 (see FIG. 2). Second gas inlet passage 42 is formed at eight places (see FIG. 3C) and gas inlet 45 at all eight places has opening height 46 of 0.3 mm and opening length 47 of 2.0 mm (see FIG. 3D).

Spraying apparatus 10 was supplied with a compressed air, which is an example of the gas, pressurized by 0.2 MPa (gauge pressure) and water, which is an example of the liquid, pressurized by 0.23 MPa (gauge pressure). A Sauter average particle diameter of the water atomized under the above conditions was evaluated by a laser diffraction technique and a noise value by a sound level meter. A measurement according to the laser diffraction technique was carried out at a position of 300 mm away from the tip of spraying apparatus 10 and a measurement of the noise value was carried out at a position of 1000 mm away from the tip of spraying apparatus 10. The result was that the Sauter average diameter was 8.6 μm and the noise value was 69 dB (A characteristic).

Figure 4A:
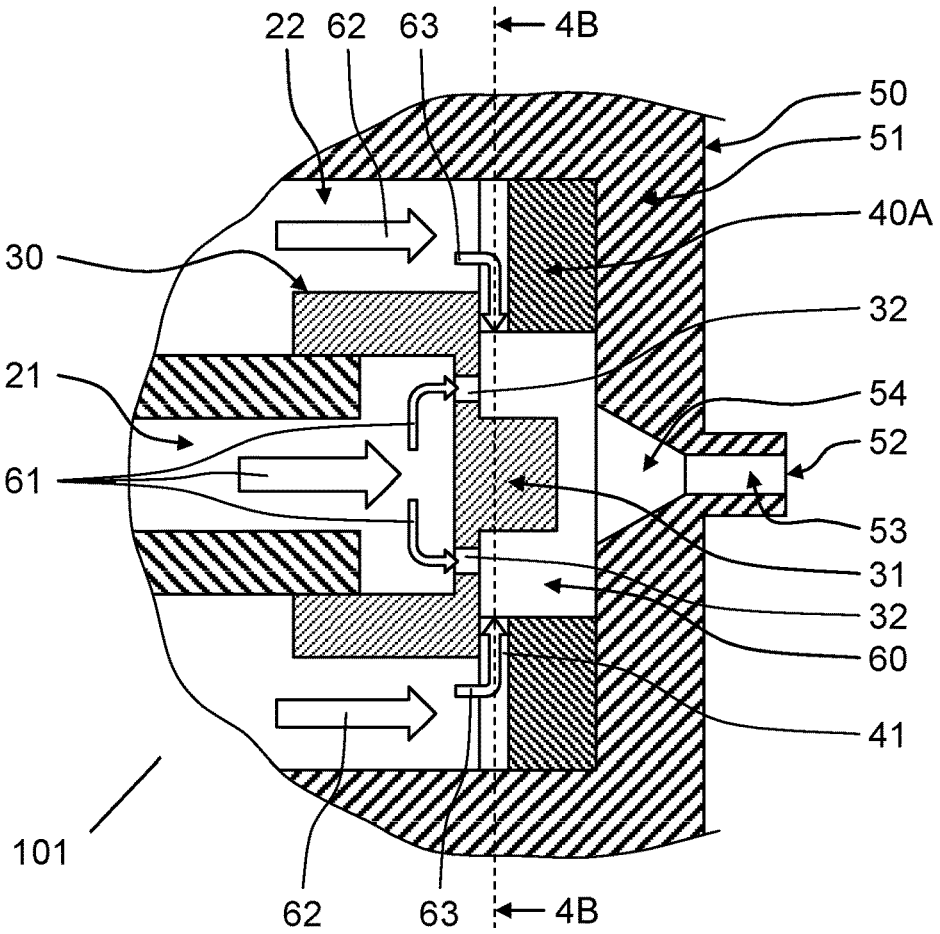
FIG. 4A is an enlarged sectional view of a gas-liquid mixer in a spraying apparatus in a comparative example.
Figure 4B:
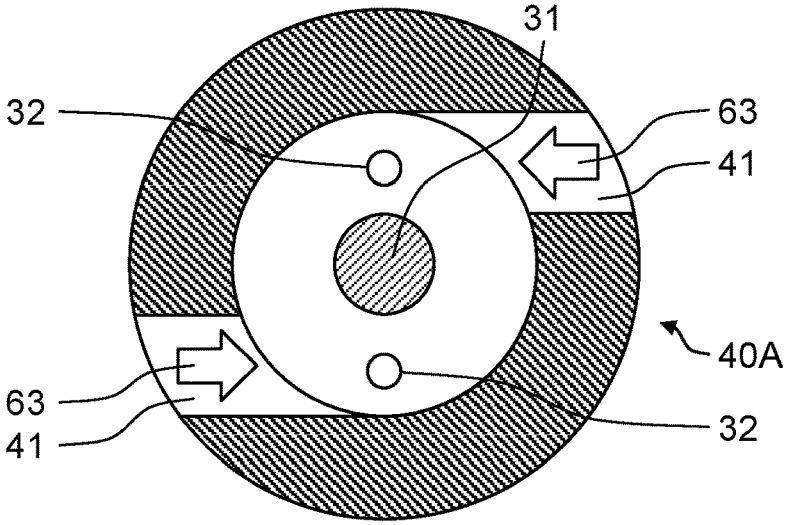
FIG. 4B is a sectional view which is taken along line 4B-4B of the spraying apparatus illustrated in FIG. 4A.

FIG. 4A is an enlarged sectional view of gas-liquid mixer 60 in spraying apparatus 101 in a comparative example, and FIG. 4B is a sectional view which is taken along line 4B-4B in FIG. 4A. Spraying apparatus 101 of the comparative example is formed of gas introduction portion 40A where second gas inlet passage 42 is removed from the structure of the embodiment. Therefore, there is no mechanism for straightening a turbulence generated by collision of first gas flow 63 and liquid flow 61 in gas-liquid mixer 60, and the noise value during spraying increases.

When spraying apparatus 101 of the comparative example was measured under the above conditions, a particle diameter was 8.5 μm and the noise value was 76 dB (A characteristic).

That is, when comparing a case where second gas inlet passage 42 is provided as illustrated in FIG. 2 and a case where second gas inlet passage 42 is not provided as illustrated in FIG. 4A, the former is more likely to reduce the noise during spraying by substantially 7 dB (A characteristic).

Next, in gas introduction portion 40 illustrated in FIGS. 3A, 3B, 3C, and 3D, a correlation between a ratio of a sum of areas of gas inlets 45 of second gas inlet passages 42 to a sum of flow passage cross-sectional areas of first gas inlet passages 41, the particle diameter, and the noise value was examined.

Here, the flow passage cross-section of first gas inlet passage 41 indicates a projection surface when the first gas inlet passage is projected in the flowing direction of the first gas flow and, in a case of the embodiment, has a rectangular shape. Gas inlet 45 is a surface where second gas flow 64 enters gas-liquid mixer 60, and the surface becomes a curved surface along inner peripheral surface 40*a* of gas introduction portion 40. Here, the area ratio is referred to as an area ratio of second gas inlet passage 42. In the examination, the area and the area ratio of gas inlet 45 of second gas inlet passage 42 are changed by changing opening height 46 of second gas inlet passage 42 without changing the shape of first gas inlet passage 41.

Specifically, first gas inlet passage 41 has a rectangular the cross-sectional shape having groove width 43 of 2.0 mm and groove height 44 of 1.0 mm (see FIG. 3D), and the flow passage is provided at two places at the positions symmetrical with central axis 11 (see FIGS. 3A and 3B). That is, the sum of the flow passage cross-sectional areas of first gas inlet passages 41 is 4.0 $mm^2$. The area of second gas inlet passage 42 was changed by changing opening height 46 of second gas inlet passage 42 connected to inner peripheral surface 40*a* of gas introduction portion 40 in a range of 0.05 mm or more and 0.6 mm or less. In gas introduction portion 40, gas inlet 45 having opening length 47 of 2.0 mm is provided at eight places (see FIG. 3C). In this case, the sum of the areas of gas inlets 45 of second gas inlet passages 42 varies in a range of substantially 1.0 $mm^2$ or more and 12.0 $mm^2$ or less, and the area ratio of second gas inlet passage 42 varies in a range of 0.25 or more and 3.0 mm or less.

A correlation between the area ratios, the particle diameters, and the noise values of spraying apparatus 10 of a case where opening height 46 is changed and second gas inlet passage 42 of spraying apparatus 101 of the comparative example is illustrated in FIG. 5.

When comparing when the area ratio is 0 with the comparative example, if the area ratio is 0.25 or more, there is a noise reduction effect of substantially 2 dB (A characteristic) and as the area ratio increases, the noise value decreases.

On the other hand, as the area ratio increases, the particle diameter increases, and if the area ratio is 3.0, the particle diameter becomes the maximum of 10.2 μm.

As described above, it is preferable that a total area of gas inlet 45 of second gas inlet passage 42 is 0.25 or more with respect to the flow passage cross-sectional area of first gas inlet passage 41 from a viewpoint of the noise value. From a viewpoint of the particle diameter, atomized mist having an area of 2.5 or less to the flow passage cross-sectional area of first gas inlet passage 41 and a particle diameter of 10 μm or less is preferable.

Therefore, when considering the conditions of both the noise value and the particle diameter, it is preferable that the area ratio, that is, a ratio of a sum of the areas of gas inlets 45 of second gas inlet passages 42 to a sum of the flow passage cross-sectional areas of first gas inlet passages 41 is 0.25 or more and 2.5 or less.

The correlation between the ratio of a sum of areas of gas inlets 45 of second gas inlet passages 42 to a sum of flow passage cross-sectional areas of first gas inlet passages 41 of gas introduction portion 40 illustrated in FIGS. 3A, 3B, 3C, and 3D, the particle diameter, and the noise value were examined by changing opening length 47.

Specifically, second gas inlet passage 42 was formed at one to eight places, opening height 46 was 0.3 mm, and opening length 47 of each gas inlet 45 was 2.25 mm. That is, a sum of opening lengths 47 is changed in a range of 2.25 mm or more and 18.0 mm or less, and in this case, a sum of areas of gas inlets 45 of second gas inlet passages 42 is changed in a range of substantially 0.05 $mm^2$ or more and 0.4 $mm^2$ or less, and an area ratio of second gas inlet passage 42 is changed in a range of 0.125 or more and 1.0 or less.

Measurement was performed on spraying apparatus 10 having the configuration described above under the same conditions as those described above. A correlation between the area ratios, the particle diameters, and the noise values of second gas inlet passages 42 of spraying apparatus 10 in a case where opening length 47 is changed and spraying apparatus 101 of the comparative example is illustrated in FIG. 6. When comparing with the comparative example (without second gas inlet passage 42) as a reference value, it was confirmed that there was a noise reduction effect by 1 dB (A characteristic) or more under a condition that the area ratio is 0.25 or more, and there was a noise reduction effect by 3 dB (A characteristic) or more under a condition that the area ratio is 0.625 or more. The noise value becomes the minimum of 72 dB (A character) under a condition of 1.0, and the noise reduction effect of 4 dB (A characteristic) could be confirmed.

As described above, the area ratio of gas inlet 45 is preferably 0.25 or more and is more preferably 0.625 or more.

Figure 7A:
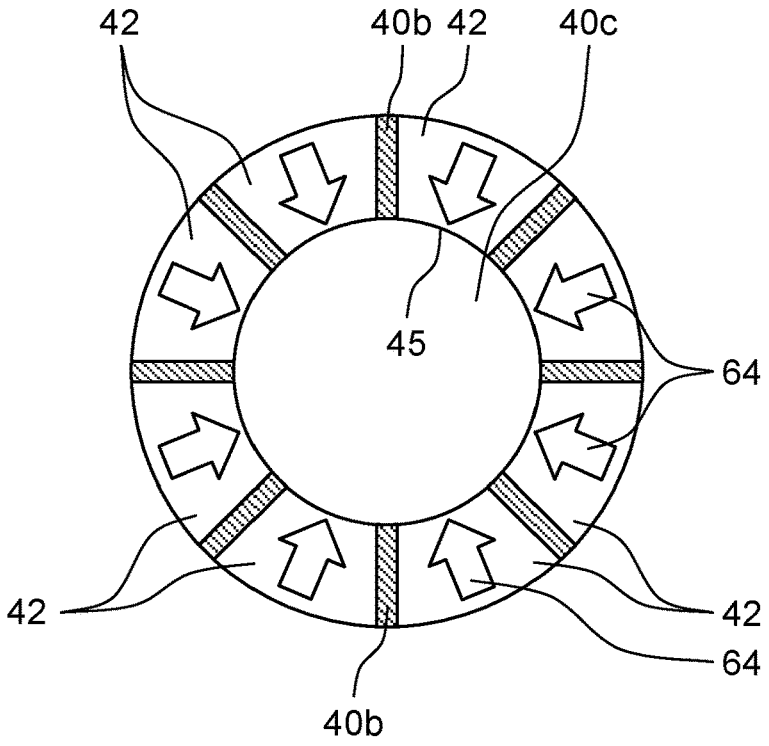
FIG. 7A is a view of the gas introduction portion as viewed from arrow 3C illustrated in FIG. 3A and illustrates a state where gas inlets are uniformly formed on an inner peripheral surface of a circular through-hole of the gas introduction portion.
Figure 7B:
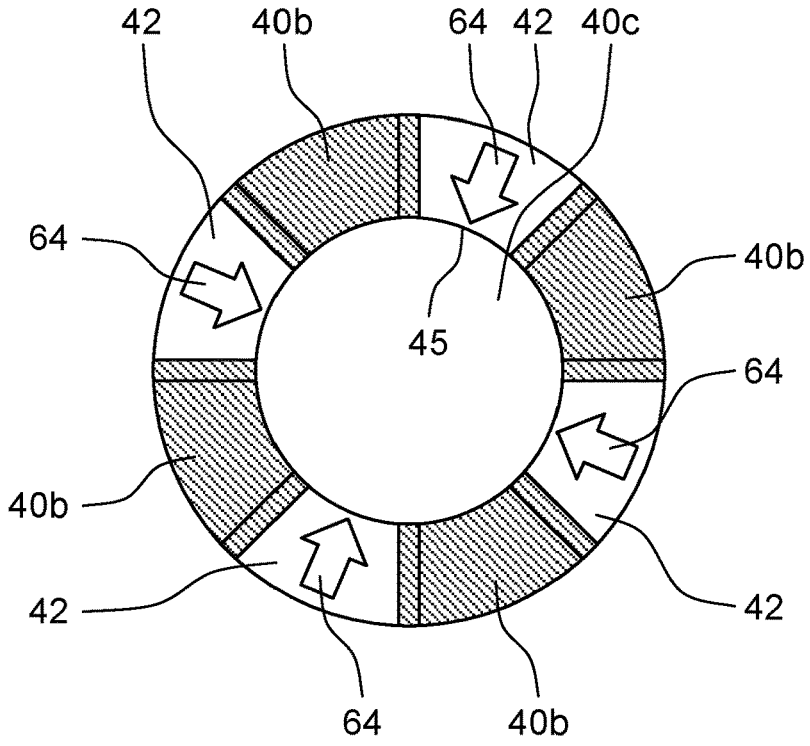
FIG. 7B is a view of the gas introduction portion as viewed from arrow 3C illustrated in FIG. 3A and illustrates a state where the gas inlets are respectively formed in a symmetrical positional relationship with respect to a central axis.
Figure 7C:
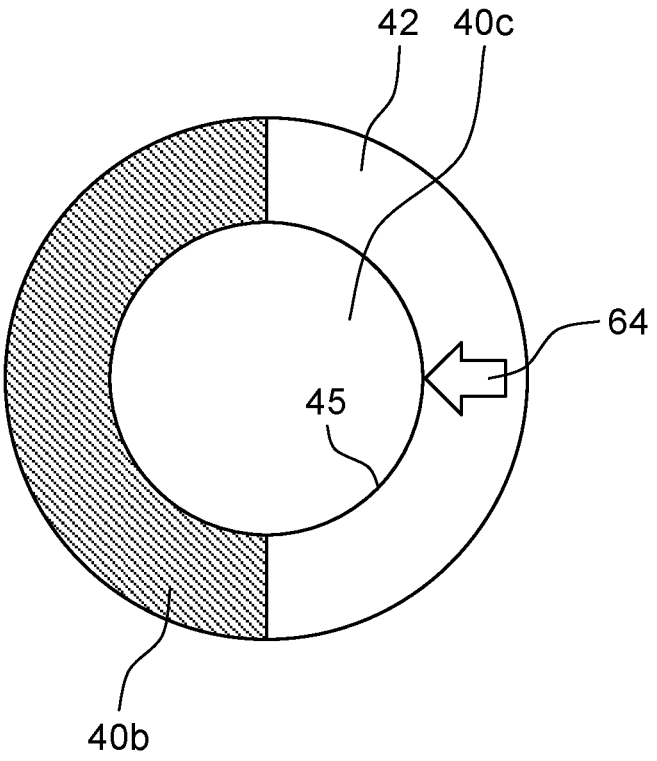
FIG. 7C is a view of the gas introduction portion as viewed from arrow 3C illustrated in FIG. 3A and illustrates a state where the gas inlet is formed at one place on an inner periphery of the gas introduction portion.
Figure 8:
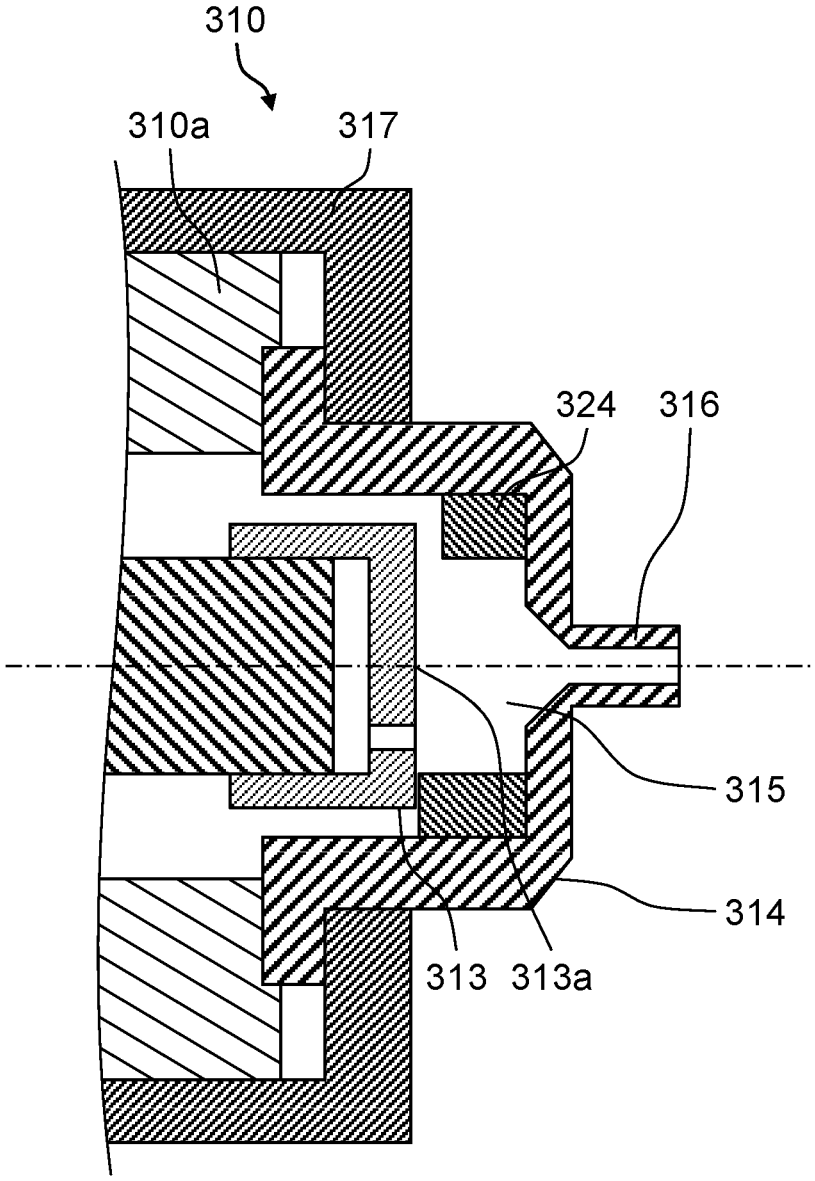
FIG. 8 is a sectional view illustrating a schematic configuration of a spraying apparatus of the related art.

As a result of the examination described above, if the sum of the areas of gas inlets 45 are equal, the same noise reduction effect is obtained even in a case where opening heights 46, opening lengths 47, and the number of forming places of gas inlets 45 are different. For example, instead of forming gas inlet 45 at eight places as illustrated in FIG. 7A, even if gas inlet 45 having opening height 46 being doubled are formed at four places as illustrated in FIG. 7B, the sum of the areas of gas inlets 45 in FIG. 3D is the same. As illustrated in FIG. 7C, even in a case where gas inlet 45 having opening height 46 being doubled and opening length 47 being quadrupled is formed at one place, the sum of the areas of gas inlets 45 in FIG. 3D is the same. Therefore, in the spraying apparatus illustrated in FIGS. 7B and 7C, the same noise reduction effect as that of the spraying apparatus illustrated in FIG. 7A is obtained. However, when atomized liquid is spouted from spout 52, it is preferable to spout the liquid more uniformly. Therefore, the spraying apparatus illustrated in FIGS. 7A and 7B is preferable to the spraying apparatus illustrated in FIG. 7C. In the spraying apparatus illustrated in FIG. 7B, each gas inlet 45 is formed in a symmetrical positional relationship with respect to central axis 11. In the spraying apparatus illustrated in FIG. 7A, gas inlets 45 are uniformly formed on the inner periphery of gas introduction portion 40. As described above, it is preferable that all second gas flows 64 enter toward central axis 11.

Note that arbitrary embodiments or modified examples of the various embodiments or the modification examples are combined, so that it is possible to achieve the respective effects thereof. In addition, combinations of the embodiments, combinations of the examples, or combinations of the embodiments and the examples are possible, and combinations of features in different embodiments or examples are also possible.

As described above, according to the spraying apparatus of the disclosure, it is possible to provide the spraying apparatus spraying the liquid with a small particle size and reducing noise generated during spraying. Therefore, the spray apparatus of the disclosure can be used for more various applications.

The spraying apparatus of the disclosure is a spraying apparatus capable of atomizing a liquid with fine and low noise. The spraying apparatus can be widely used for cooling or humidifying a space or a substance, spraying chemical solution, burning, dust control, or the like.

What is claimed is:

1. A spraying apparatus comprising:

a spraying apparatus main body that has a liquid flow passage and a gas flow passage;

a liquid introduction portion that is on a central axis of the spraying apparatus main body, is disposed at a tip of a cylindrical portion forming the liquid flow passage on an inside thereof, and covers an opening of the cylindrical portion;

a gas-liquid spout portion that is disposed at a tip of the spraying apparatus main body, covers the liquid introduction portion, and covers an opening of the gas flow passage;

an annular gas introduction portion that is positioned between the liquid introduction portion and the gas-liquid spout portion, and is in contact with the liquid introduction portion and the gas-liquid spout portion;

a gas-liquid mixer formed of an interior space defined between the liquid introduction portion, the annular gas introduction portion and the gas-liquid spout portion;

a liquid inlet that is provided at at least one position on a downstream-side end surface of the liquid introduction portion, the at least one position being distant from the central axis, wherein the liquid inlet directly communicates with the gas-liquid mixer, and allows a liquid flow flowing through the liquid flow passage to enter the gas-liquid mixer;

a first gas inlet passage that is provided at at least one place in the annular gas introduction portion so as to communicate with the gas flow passage and so as to directly communicate with the gas-liquid mixer, and allows a gas flow flowing through the gas flow passage to enter the gas-liquid mixer, the first gas inlet passage being formed to extend along a tangential direction of an inner peripheral surface of the annular gas introduction portion;

a second gas inlet passage that is provided in the annular gas introduction portion on a downstream side of the first gas inlet passage, communicates with the gas flow passage and directly communicates with the gas-liquid mixer, and has a gas inlet having a predetermined area ratio, the second gas inlet passage being formed to extend in a direction orthogonal to the central axis; and a spout that is provided in the gas-liquid spout portion, communicates with the gas-liquid mixer, and spouts an atomized liquid in the gas-liquid mixer, wherein a first gas flow entering from the first gas inlet passage intersects with the liquid flow entering from the liquid inlet and is configured to flow along an inner circumference of the gas introduction portion, and wherein a second gas flow entering from the second gas inlet passage is configured to rectify turbulence inside the gas-liquid mixer.

2. The spraying apparatus of claim 1, wherein the liquid inlet is formed of a through-hole on an end surface of the liquid introduction portion along the central axis, and allows the liquid flow flowing through the liquid flow passage to pass through the through-hole to enter the gas-liquid mixer, wherein the first gas inlet passage is formed of a first gap that is formed between the liquid introduction portion and an upstream-side end portion of the gas introduction portion, the first gap being formed to extend along a direction intersecting a direction of the central axis and to communicate with the gas flow passage and directly communicate with the gas-liquid mixer, wherein the second gas inlet passage is formed of a second gap and a third gap, wherein the second gap is formed between the gas-liquid spout portion and an outer surface of the gas introduction portion, and is formed to extend along a direction of the central axis and communicates with the gas flow passage, and wherein the third gap is formed between the gas-liquid spout portion and a downstream-side end portion of the gas introduction portion, the third gap being formed to extend along a direction intersecting the direction of the central axis and to communicate with the second gap and directly communicate with the gas-liquid mixer.

3. The spraying apparatus of claim 1, wherein the predetermined area ratio is a ratio of a sum of areas of the gas inlets of the second gas inlet passages to a sum of flow passage cross-sectional areas of the first gas inlet passages, and is 0.25 or more and 2.5 or less.

4. The spraying apparatus of claim 2, wherein the predetermined area ratio is a ratio of a sum of areas of the gas inlets of the second gas inlet passages to a sum of flow passage cross-sectional areas of the first gas inlet passages, and is 0.25 or more and 2.5 or less.

5. The spraying apparatus of claim 1, further comprising:

a tapered truncated conical straightening passage arranged so as to communicate with a downstream side of the gas-liquid mixer; and a tubular flow passage arranged so as to communicate with a downstream side of the tapered truncated conical straightening passage, wherein the atomized liquid in the gas-liquid mixer is spouted from the spout through the gas-liquid mixer, the tapered truncated conical straightening passage, and the tubular flow passage.

6. The spraying apparatus of claim 5, wherein an inner diameter of the tubular flow passage is smaller than an inner diameter of the annular gas introduction portion.

* * * * *